United States Patent [19]

Hasegawa

[11] 4,194,218

[45] Mar. 18, 1980

[54] INSPECTION APPARATUS FOR UNDERGROUND CHANNELS

[75] Inventor: Kiyoshi Hasegawa, Tokyo, Japan

[73] Assignee: Kabushiki Kaisha Kantool, Tokyo, Japan

[21] Appl. No.: 388

[22] Filed: Dec. 29, 1978

[51] Int. Cl.[2] ..... H04N 7/18

[52] U.S. Cl. ..... 358/100

[58] Field of Search ..... 358/100, 108, 285, 286

[56] References Cited

U.S. PATENT DOCUMENTS

| | | | |
|---|---|---|---|
| 3,064,077 | 11/1962 | Cary | 358/286 |
| 3,541,248 | 11/1970 | Young | 358/285 |
| 3,715,484 | 2/1973 | Latall | 358/100 |
| 3,739,095 | 6/1973 | Alden | 358/285 |
| 3,761,623 | 9/1973 | Hara | 358/100 |
| 3,885,091 | 5/1975 | Fish | 358/100 |
| 3,958,080 | 5/1976 | Schadler | 358/100 |
| 3,984,627 | 10/1976 | Galerne | 358/100 |
| 4,107,738 | 8/1978 | Van Norman | 358/100 |

*Primary Examiner*—Howard W. Britton

*Attorney, Agent, or Firm*—Fleit & Jacobson

[57] ABSTRACT

An inspection apparatus for underground channels such as sewer pipes and conduits for communication or electric cables and many other conduits for various utilities. The apparatus has a television camera which is adjustable in its position in accordance with the size of an underground channel, and a reversible motor which rotates V belts to advance and retract the apparatus in the underground channels. The television camera and the movement of the apparatus is controlled at a remote place.

5 Claims, 6 Drawing Figures

15
16
11
14
14a
1a
13
20
1
22
11b
12b
13'
12
12a
11a
21
23
19
17
2
A

INSPECTION APPARATUS FOR UNDERGROUND CHANNELS

BACKGROUND OF THE INVENTION

The present invention relates generally to an apparatus or movable body which enables an inspection for pipes and conduits for sewerage or water supply and conduits for telephone cables, electric cables and so forth which are generally embedded underground. Particularly, the present invention relates to such inspection apparatus for remotely inspecting the underground channels.

Conventionally, a movable body such as a sleigh or sledge on which a T.V. camera is installed is inserted into an underground channel so that the underground channel may be inspected remotely by means of the T.V. camera. In the conventional apparatus described above, the sledge is connected at its front portion with a guide wire which is extended to a manhole, and the rear portion is connected to other guide wire which is extended to the other manhole, wherein the underground channels to be inspected are located. The guide wires are connected to winding machines such as winches so that the sledge may be moved opposite directions by driving the two winding machines. Namely, the sledge is moved in one direction and other by means of the winding machines which are located adjacent to the above described manholes which contain therein the underground channels to be inspected.

However, according to the above described system, at least two operational personnels should be needed at the position where the two winding machines are positioned. Furthermore, the guide wires should previously be inserted into the underground channels through the manhole, and if it difficult or impossible to insert the guide wire into the underground channel for some reasons as subside, depression or the like, the conventional system cannot be applied. Namely, the underground channels should have suitable conditions for insertion of the guide wires.

Accordingly, an object of the present invention is to provide a new apparatus for inspection of underground channels, wherein the apparatus is movable freely in the channels without any guide wires.

Another object of the present invention is to provide a new inspection apparatus which permits a free movement in opposite directions by a remote control within an underground channels.

Another object of the present invention is to provide an inspection apparatus which permits a desirable inspection of the underground channels regardless of any obstructions within the underground channels.

Further object of the present invention is to provide an inspection apparatus which can absorb most of the skocks produced by the movement of the apparatus in the underground channels.

SUMMARY OF THE INVENTION

Briefly, the present invention provides an inspection apparatus for underground equipments as pipes and conduits, which comprises a chassis which has first pulleys at one end portion and second pulleys at the other portion of the chassis. The apparatus comprises further endless V belts engaged with the first and second pulleys, a reversible motor, a television camera, and a device for adjusting the position of the television camera in accordance with the size of the channels. The television camera and the reversible motor are operated and controlled remotely by way of a cable.

Other objects and features of the present invention will become apparent from the detailed description of preferred embodiments thereof, which will be read with reference to the accompanying drawings.

DETAILED DESCRIPTION OF THE INVENTION

Figure 1:
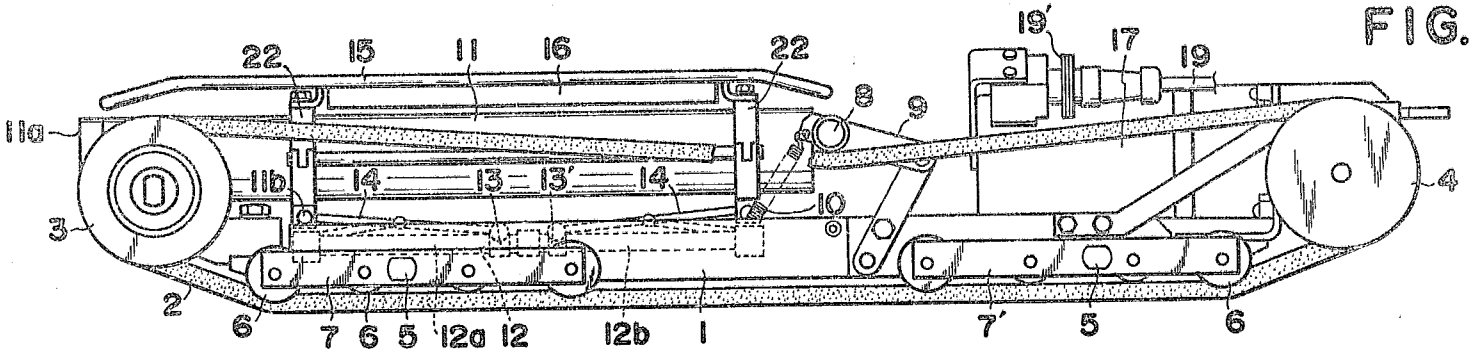
FIG. 1 is a side view of an apparatus embodying the present invention.

Like reference numerals represent like parts in the different and various views of the drawings.

An apparatus of the invention has a chassis, which is generally illustrated by reference numeral 1, and pulleys 3 at a front portion thereof and driving pulleys 4 at a rear portion thereof. On the pulleys there are provided V belts 2. The pulleys 3 and 4 are disposed upward from the bottom surfaces of the V belts. The chassis 1 has, on its sides, elongated front saddles 7 and elongated rear saddles 7' at the front portion and rear portion, respectively. Each of the saddles 7, 7' has a plurality of rollers or wheels, which are generally illustrated by reference 6. The saddles 7, 7' are connected to the chassis at the middle portion thereof by means of pins 5 such that the saddles 7, 7' may be pivoted in the opposite directions about the pins 5. The chassis 1 has rollers 8 above the endles V belts 2 for adjustment of a tensil strength of the V belts. The rollers 8 are connected to arms 9 and pressed downwardly onto the V belts by means of springs 10. On the front portion of the chassis 1 is provided a cylindrical T.V. camera 11 which can be shifted upward and downward by means of a link mechanism 14, an example of which will be described with reference to FIGS. 4 and 5.

Figures 4, 5, 6:
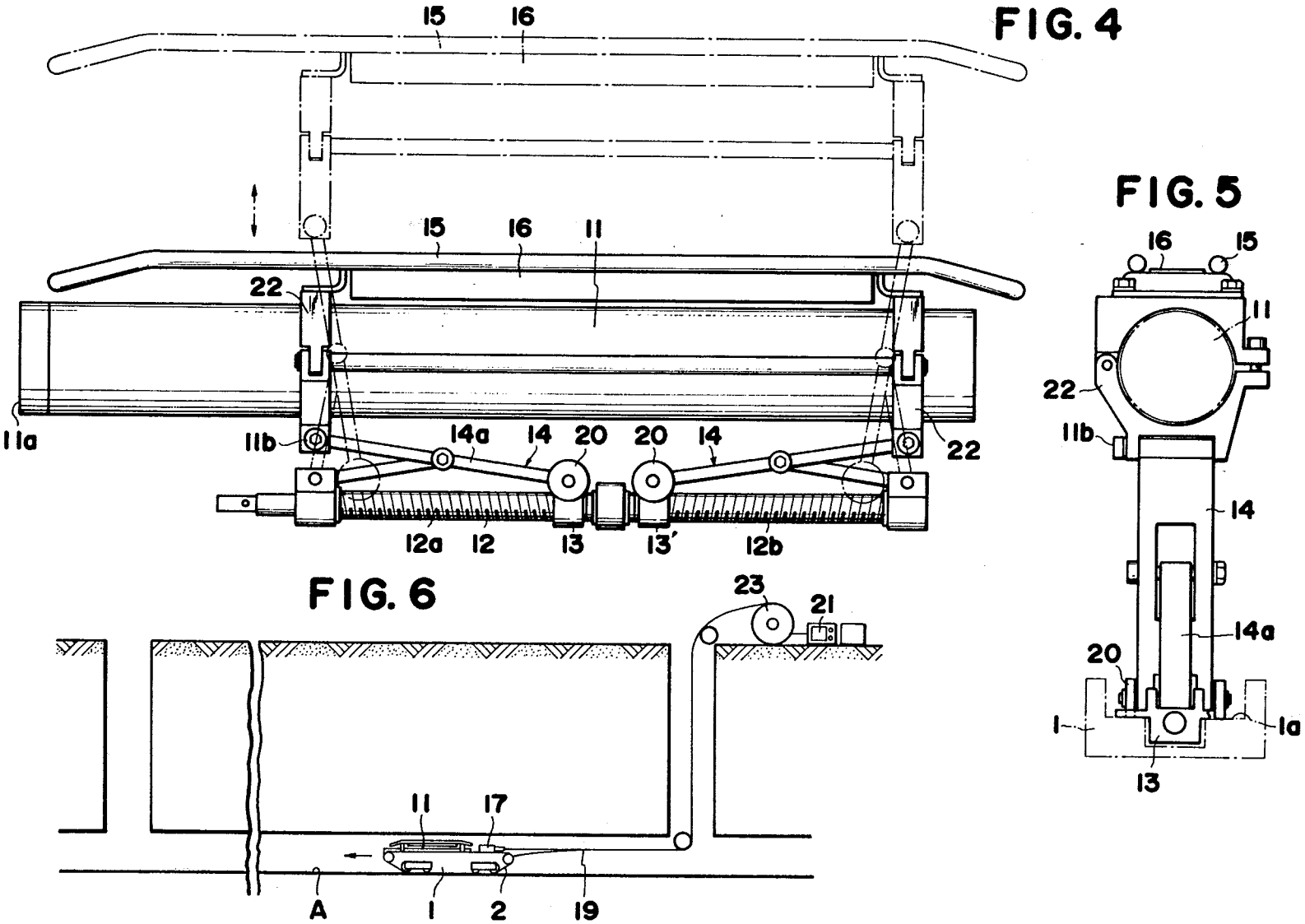
FIG. 4 is an enlarged side view of a part of the apparatus illustrated in FIG. 1, showing a mechanism for lifting a T.V. camera installed on the apparatus.
FIG. 5 is a rear view of the enlarged portion illustrated in FIG. 4.
FIG. 6 shows the apparatus of the present invention in use, showing that the apparatus moves along an underground channel by a remote control system.

As shown is FIGS. 4 and 5, the link mechanism 14 has a shaft 12 which has a first spiral groove portion **12*a* and a second spiral groove portion 12*b* so that a rotation of the shaft 12 in one direction urges a block 13 to move in one direction and a block 13' to move in the other direction. The shaft 12 is rotatably connected to the chassis 1. The lever 14*a* of the link mechanism 14 has rollers 20 which rotate along a base 1*a* of the chassis 1. The link mechanism 14 is connected to a T.V. camera holder 22 by means of a pin 11*b*. Above the television camera 11, two protective guide bars 15 are disposed for the purpose of protecting the camera when the camera together with the chassis 1 moves back and forth. Between the protective guide bars there is provided a detachable vessel 16** for collecting a leakage from the above.

Figure 2:
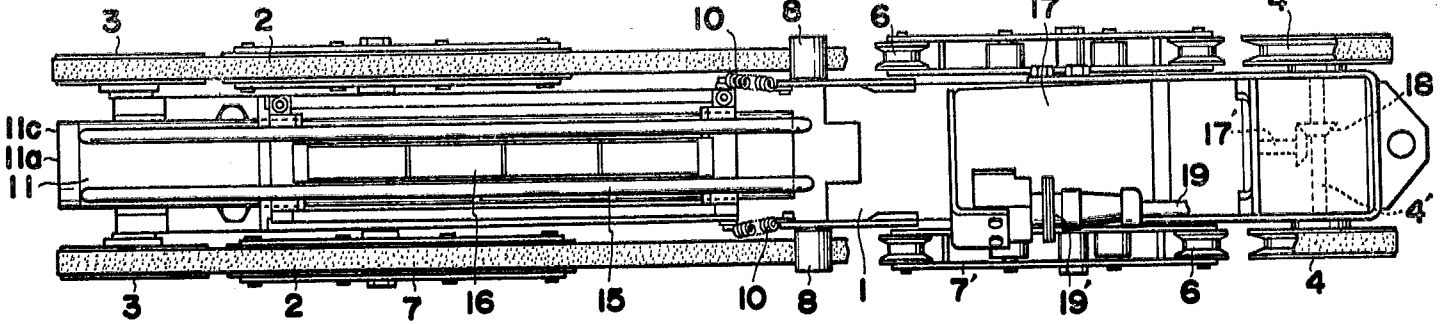
FIG. 2 is a plan view of the apparatus illustrated in FIG. 1.
Figure 3:
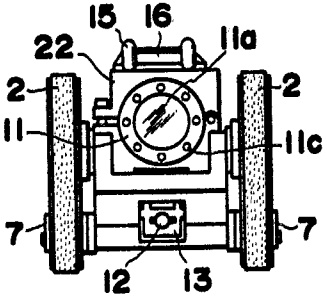
FIG. 3 is a front view of the apparatus illustrated in FIG. 1.

Referring to FIGS. 1 and 2, the chassis 1 has at its rear portion a reversible motor 17 which has a driving shaft 17' rotatable in clockwise and counterclockwise directions. The driving shaft 17' is connected to a shaft 4' of the driving pulley 4 though a bevel gear 18 such that a driving force, either clockwise or counterclockwise directions, may be transmitted to the shaft 4' of the driving pulley 4. In the drawing, particularly FIGS. 1 and 2, reference numeral 19 represents an electrical cable which is connected to a connector 19' for driving and controlling the television camera 11 and the motor 17.

For the purpose of understanding further the structural features of the inventive apparatus described above, an operation of the apparatus will be described hereinunder. First, the television camera 11 is arranged and set in its position by lifting or lowering the position thereof in accordance with a diameter of the underground channel A as illustrated in FIG. 6 so that the lens portion 11*a* of the television camera 11 may be positioned at a substantially central or axial portion of the underground channel A. It will be readily understand that the adjustment of the position of the television camera can be easily carried out by rotating the shaft 12 in clockwise and counterclockwise directions, which is shown in FIG. 4. A rotation of the shaft 12 permits the blocks 13 and 13' to move in the opposite directions to thereby raise the camera holder 21 as well as the camera 11, as well illustrated by phontom lines in FIG. 4. It will be inderstood that the rollers 20 facilitate a smooth movement of the blocks 13, 13' and prevents the camera from being swayed laterally.

After the position of the camera is fixed by rotation of the shaft 12, the apparatus having the television camera is inserted into the underground channel A from a manhole, and the motor 17 is driven remotely by way of the cable 19. The motor 17 transmits its driving force to the driving pulleys 4, which rotates the endless V belts engaged with the driving pulleys 4 and the pulleys 3. At the same time, the television camera 11 and illuminators 11*c*, which are installed around the lens 11*a* of the camera, are switched on so that an image of the area to be inspected may be viewed and displayed on a monitor television set 21 disposed on the ground, as illustrated in FIG. 6. An inspection personel, upon watching the monitor television set, may be able to note the inspected area of the underground conduits and pipes and find defects and deficiencies of those underground equipments. Further the inspection personnel can note accurate status of the underground channels.

Even though there are piles and accumulations on the bed of the underground channel A, the apparatus which are moved by the V belts 2 can ride over these piles and accumulations and continue the inspection working. Vertical shocks induced to the apparatus particularly when the V belts ride over the piles and accumulations will be absorbed to a maximum extent by the combination of the rollers 6 and the saddles 7, which are pivotally connected to the chassis 1 at the middle portion thereof. Thus, most of the shocks may be absorbed and not transmitted to the television camera 11. Further, the application of V belts 2 ensures a desired movement of the apparatus.

The vessel 16 for collecting leaked water permits an inspection of the leaked water whether it is leaked out from a sewer pipe or water supply pipe and whether it is a drip due to a rainfall. The water inspection will be carried out after the vessel is removed from the apparatus.

Upon completion of the inspection of the underground channels, the apparatus is retracted by driving the reversible motor 17 by way of the cable 19. Similary, in case that the apparatus cannot advance any further due to some piles or any other obstacles or due to a depression of the underground channel, the apparatus is retracted by driving the reversible motor 17.

It will be understood from the above, the apparatus of the present invention can be advanced or retracted by merely driving the motor 17 at a remote place. Accordingly, the apparatus require only a single personnel for inspecting the underground channels such as conduits sewer pipes and any other pipes for various utilities.

At the time of retraction of the apparatus, it will be readily understood that the cable 19 is simultaneously wound by means of a winding machine 23, which is positioned at the entrance or opening of the underground channel A.

According to the apparatus of the present invention in which the position of the television camera is adjustable in accordance with the size of the underground channels, and in which the apparatus is advanced and retracted by a remote control system, a guide cable or the like which has been material and prerequisite to the conventional apparatus is not needed any more. Further, a single working personnel can carry out a desired and efficient inspection by watching the monitor television set which views and displays the image of inspection area by means of the television camera. Therefore, even though the underground channel is depressed to an extent that the conventional guide cable cannot be inserted, the apparatus of the present invention can advance to the position of such depression and send the views and images of the depressed area to the monitor television set so that the personnel can realize accurately the depression.

If necessary, the cable 19 is provided with scales or graduation lines so that an exact place of the depressed area as well as an inspecting position can be noted.

It will be readily understood that the apparatus particularly television camera and motor, is of waterproof design.

While the particular inspection apparatus for underground equipments such as sewer pipes, and conduits for communication cables and electric cables, etc. herein shown and disclosed in detail is fully capable of attaining the objects and providing the advantages hereinbefore stated, it is to be understood that it is merely illustration of the presently preferred embodiments of the invention and that no limitations are intended to the details of construction or design herein shown other than as defined in the appended claims.

What is claimed is:

1. An inspection apparatus for underground channels comprising a chassis which has pulleys at the end portions thereof, endless V belts engaged with said pulleys, a reversible motor having a driving shaft, a television camera at one end portion of said chassis, means for adjusting the position of said television camera in accordance with the size of said channels, and cable means for remotely operating and controlling said television camera and said reversible motor.

2. The inspection apparatus according to claim 1, in which said apparatus comprises further means for adjusting the tensile strength of said V belts.

3. The inspection apparatus according to claim 1, in which said means for adjusting the position of the television camera includes a shaft which has a first spiral groove portion and second spiral groove portion, a first block threadedly engaged with and movable along said first spiral groove portion, a second block threadedly engaged with and movable along said second spiral groove portion, link members, and a camera holder, said link members being connected to said camera holder and said blocks, whereby when said shaft is rotated, said blocks move in the opposite direction to thereby shift the position of said camera holder.

4. The inspection apparatus according to claim 1, in which said chassis has a first saddle and second saddle, said first and second saddles having rollers which contact said V belts, said first and second saddles being pivotable about the central portion thereof.

5. The inspection apparatus according to claim 1, in which a plurality of illuminators are disposed around a lens of said television camera.

* * * * *